US006553997B2

(12) United States Patent
Illas

(10) Patent No.: US 6,553,997 B2
(45) Date of Patent: Apr. 29, 2003

(54) DEVICE FOR TRAINING AN EXTREMITY OF THE HUMAN BODY FOR THE PRACTICE OF A SPECIFIC PHYSICAL ACTIVITY

(75) Inventor: Elias Galobardes Illas, Barcelona (ES)

(73) Assignee: G I G Gestio I Assessorament Esporttu S.C.P. (ES)

( * ) Notice: Subject to any disclaimer, the term of this patent is extended or adjusted under 35 U.S.C. 154(b) by 0 days.

(21) Appl. No.: 09/936,893

(22) PCT Filed: Jan. 18, 2001

(86) PCT No.: PCT/ES01/00012

§ 371 (c)(1),
(2), (4) Date: Sep. 18, 2001

(87) PCT Pub. No.: WO01/52954

PCT Pub. Date: Jul. 26, 2001

(65) Prior Publication Data

US 2002/0160893 A1 Oct. 31, 2002

(30) Foreign Application Priority Data

Jan. 19, 2000 (ES) ..... 200000100

(51) Int. Cl.[7] ..... A61F 5/37
(52) U.S. Cl. ..... 128/878; 128/879; 602/20
(58) Field of Search ..... 602/5, 13, 20, 602/21, 22; 628/877, 878, 879

(56) References Cited

U.S. PATENT DOCUMENTS

| | | | | | |
|---|---|---|---|---|---|
| 3,423,095 | A | * | 1/1969 | Cox | 128/133 |
| 3,693,973 | A | | 9/1972 | Wattenburg | |
| 3,942,522 | A | * | 3/1976 | Kinnier Wilson | 128/90 |
| 4,925,187 | A | * | 5/1990 | Fleenor | 128/90 |

FOREIGN PATENT DOCUMENTS

| | | |
|---|---|---|
| FR | 2213073 | 8/1974 |
| WO | 9119548 | 12/1991 |

* cited by examiner

*Primary Examiner*—Michael A. Brown
(74) *Attorney, Agent, or Firm*—Ostrolenk, Faber, Gerb & Soffen, LLP

(57) ABSTRACT

This device for the training of a human body extremity in the practice of a specific physical activity, is comprised of a concave mould that, made up of at least a rolled piece of light and substantially rigid material, the first part is shaped on the inside which is adjusted and substantially wraps around the extremity and its joint to a limb. This being the part where the immobilisation is kept held to the optimally correct position for a piece of equipment for the exercising of the type of action in the specific physical activity, and a second part that is adjusted and substantially wraps the part of the member next to the joint.

10 Claims, 2 Drawing Sheets

DEVICE FOR TRAINING AN EXTREMITY OF THE HUMAN BODY FOR THE PRACTICE OF A SPECIFIC PHYSICAL ACTIVITY

This invention refers to a device for the training of a human body extremity in the practice of a specific physical activity, particularly an accessory aimed at educating a human body extremity so that it easily adopts a correct position for the exercising of a sporting activity, in regard to the limb and by means of the joint.

It is known that for the exercising of a physical activity in which a tool, instrument, piece of equipment etc., must be used, it is extremely important in order to achieve the maximum performance, to suitably handle the piece of equipment, which involves a specific way of holding same, a specific position for holding the extremity in regard to the limb and a specific way of moving the member by means of the elbow and/or shoulder joints.

This circumstance has an important relevance in the exercising of sports in which a racquet is used to propel a ball, such as in the game of tennis, which can be extended to other games such as "squash", "paddle" etc. However, in other sports the posture of the body is also important and other ways of holding the sporting piece of equipment, such as in golf, fencing, hockey, pelota (a Basque game played in a walled court), etc. Neither can the proper use of tools in some professions or trades in areas where a better quality product, greater productivity and less fatigue and risk of an accident to the operator be excluded.

For the purpose of educating an extremity of a limb, specifically a hand, to hold a sporting piece of equipment in the correct way and to adopt a wrist position that relates to the first with the forearm in accordance with a specific angle in line with the needs required in each type of action or stroke of the game, in such a way that the player, is unconsciously adopting with ease and perfection to the suitable position of the hand and carries out the movement of the entirety of the hand, wrist and forearm by means of playing the elbow and/or shoulder and not of the wrist, it would be desirable to have an educative method that will avoid the player a long and hard period of training. This would be difficult or impossible for many individuals to carry out because of the lack of time, perseverance and/or dedication. These circumstances lead to bad training in the players that, because of the anxiety of being able to play as soon as possible make them pick up bad habits that will stop them in the future from becoming tennis stars or, simply good players.

In accordance with the above premise the solution has been adopted for the establishment of some physical means that, when applied to the player for some training periods, prevent him/her from picking up bad habits of posture and induce him/her to unconsciously adopt the optimum holding position of the piece of sports equipment during the game phases.

Taking into account the solution stated in the above paragraph, a device has been developed for the training of an extremity of the human body in the practice of a specific physical activity, which is the purpose of the invention, which is comprised of a concave mould that, is made up of at least one rolled piece of light and substantially rigid material, is shaped on the inside in the first part which is adaptable and substantially wraps around the extremity and its joint to a limb, being this part where the immobilisation is kept held to the optimally correct position for a piece of equipment for the exercising of the type of action in the specific physical activity. There is also a second part that is adjusted and substantially wraps the part of the member next to the joint, the piece having on this second part some means of openable fixings provided so as to fix it to the limb.

One characteristic of the invention comprises in that the mould, in the first part, is able to hold the extremity and its joint of the limb together with the extremity and its joint in the correct position to hold the piece of equipment for the type of action in the specific physical activity, whilst the second part houses only one of the two limbs and has some means of openable fixings provided so as to fix it to the limb.

Another characteristic of the invention lies in that the device, in its application to a hand, to the wrist joint and to the forearm of an upper limb, the concave shape, on the first part allows the holding in an adjustable way and without freedom of movement of the hand and the wrist, the holding of the piece of equipment for the development of the physical activity.

In this case, the invention considers the possibility of the sizing of the first part of the piece of the mould is such that it freely allows the direct introduction of the hand, the piece of equipment being correctly gripped for the development of the physical activity, which will allow it to be housed together in a way that is adapted to the mould.

The invention considers that the first and second parts of the mould correspond to two independent pieces that can be fitted together rigidly and which can be opened, in which case, there is the possibility that the piece of the second part is constant for a single limb size, the shape and the number of pieces of the first part being variable in line with the position to be adopted by the extremity and its joint for each type of action and posture of the physical activity.

On the other hand, it has been provisioned that the internal surface of the mould has a non-aggressive springy nature for the user's extremity, joint and limb, said non-aggressive surface could be made up of a cushioning of any type of material that, optionally could be inserted or removed.

The light rigid material of the piece of the mould is one of a group of synthetic resin materials, reinforced or not, and light metals, all of which can be separate or in combination.

In order to make the preceding ideas easier to understand, a description is given below of an embodiment of the invention device, making reference to the illustrative drawings that are attached. In the drawings:

FIG. 1, represents a simplified perspective of the invention device, seen from its concave side, that is suited for the training of a right-handed tennis player in the shot called "drive".

FIG. 2, also represents a perspective view, the device from the previous figure, fixed to the hand, wrist and forearm of a player, is fixed to said forearm by conventional fixings.

Figure 1:
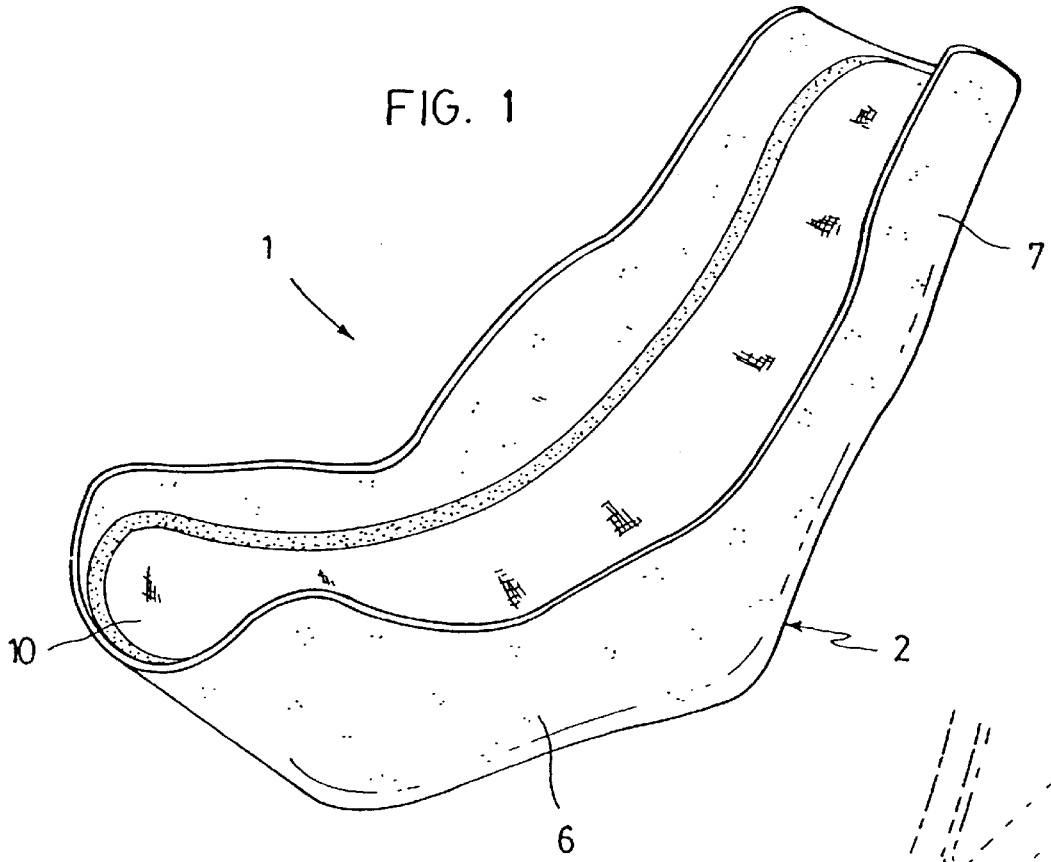

The training device in accordance with the invention is made up, as shown in FIG. 1, from a concave shape 1 made from, at least, one sheet 2 of light and substantially rigid material, such as synthetic resins, reinforced or not, and/or light metal, all of which can be separate or in combination.

Figure 2:
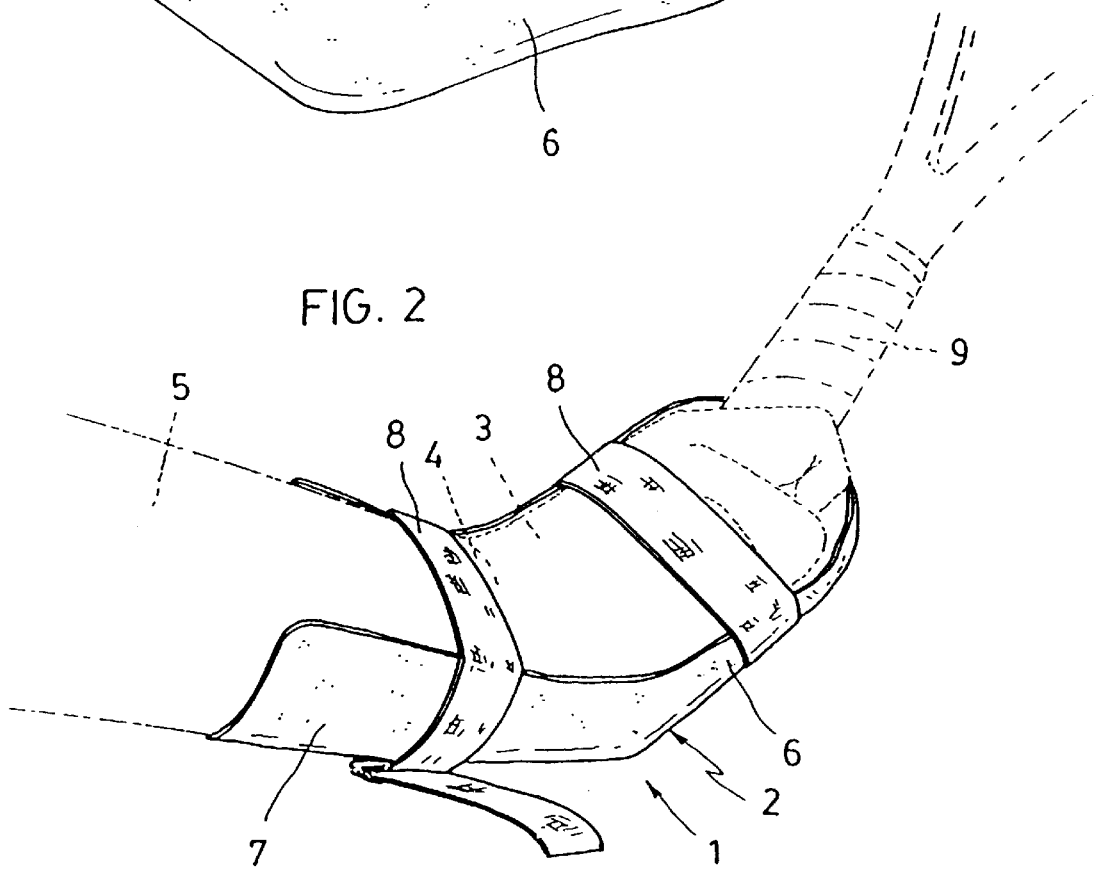

In the case of application to one hand 3, the wrist 4 and the forearm 5 of an upper limb or arm, the piece of sheet material 2 that makes up the concave mould 1, as can be seen in FIG. 1. It is made up on the inside of a first part 6 which is adapted and substantially wraps around the extremity of the hand 3 and the joint with the wrist 4 in the forearm limb 5, as shown in FIG. 2, where the hand 3 and the wrist 4 where the immobilisation is kept held to the optimally correct position for a piece of equipment for the exercising of the type of action in the specific physical activity. There is a second part 7 that is adjusted and substantially wraps the part of the forearm limb 5, next to the wrist joint 4, being in this part 7 where the rolled piece 2 has some means of openable fixings 8 provided so as to fix it to the forearm limb 5.

Figure 5:
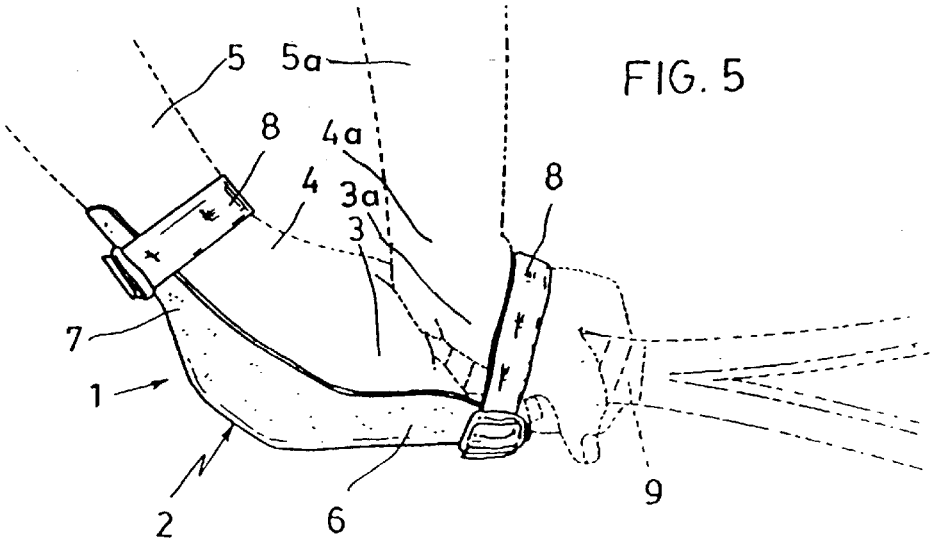
FIG. 5, represents a perspective view, similar to the previous case, a device in accordance with the invention, suited for training of a right-handed tennis player in the shot called two handed thrust.

The invention provisions for the case in which the concave mould 1, on its first part 6, is capable of housing, in the correct way of holding a piece of equipment 9, to the extremity 3 and the joint 4 of a limb 5 together with the extremity 3*a* and the joint 4*a* of another limb 5*a,* whilst in the second part 7, it houses only one of the two said limbs 5 and has some means of openable fixings 8 provided so as to fix it to same. The carrying out of this is represented in FIG. 5 of the drawings, it is adapted to the case of grasping a piece of equipment 9 with both hands, in the specific case of tennis to the racquet the hit with two handed thrust, or in other cases such as, the club in golf, etc.

The sizing of the first part 6 of the rolled piece 2 of the concave mould 1 is such that it freely allows the direct introduction of the hand 3 and of the wrist 4, the piece of equipment 9 grasping them so as to develop the specific physical activity, which eases the housing of the entirety in a way that can be adjusted in the concave mould 1.

It has also been planned, but not drawn, that the mould 1 is made from two independent pieces, rigidly fitted together in an openable manner, that corresponds to the first and second parts of same.

In such a case, the piece of the second part is constant for the same size of forearm limb, the shape and the numbers of the pieces of the first part being variable, in line with the position to be adopted by the extremity and its joint to each type of action and posture of the physical activity.

The internal surface of the concave mould 1 shows a non-aggressive springy nature for the user, which could be made up of a cushioning 10 of any type of material which, optionally could be inserted or removed.

The application of this device is for use not only for the hands, but also, it can be used for the feet, ankles and calves.

Figure 3:
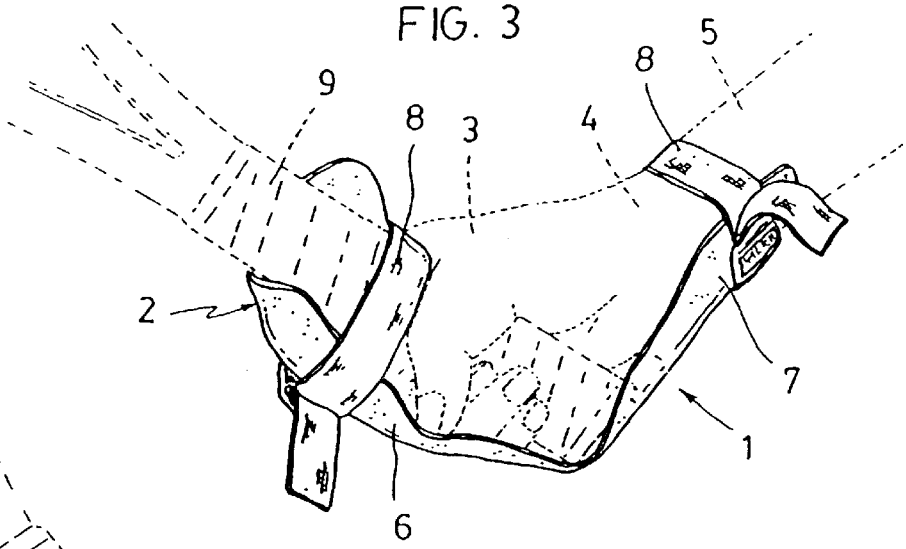
FIG. 3, represents a perspective view, similar to the previous case, a device in accordance with the invention, suited for training of a right handed tennis player in the shot called back hand.
Figure 4:
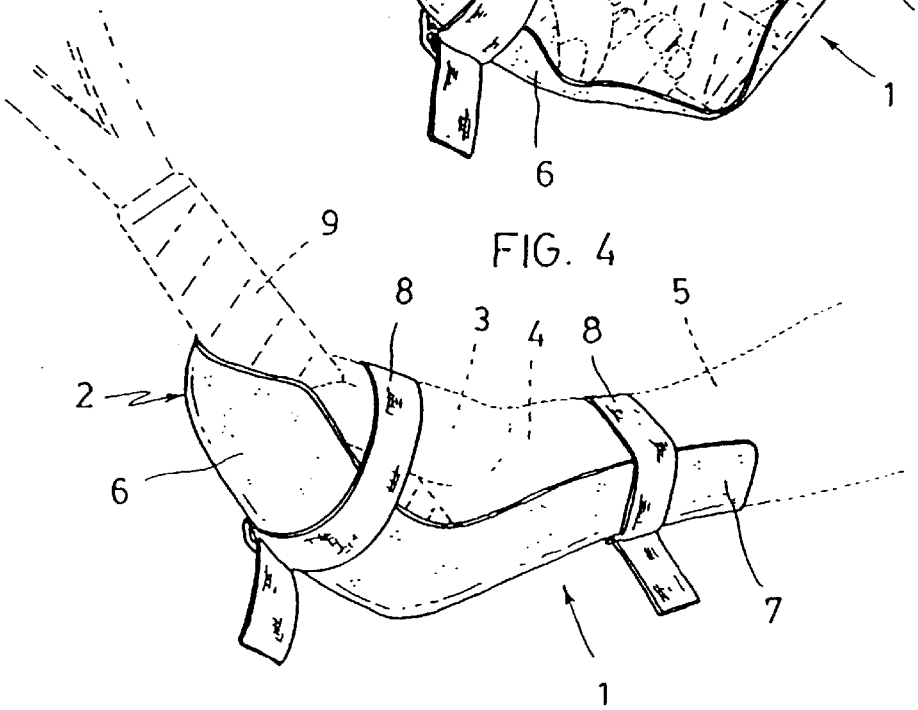
FIG. 4, represents a perspective view, similar to the previous cases, a device in accordance with the invention, suited for training of a right-handed tennis player in the shot called back handed drop.

In FIGS. 3 and 4 the specific devices have been shown for the back hand shots and back hand drop shots, suitable for a right-handed tennis player. Evidently, there are similar devices for left-handed tennis players.

Similarly, concave moulds 1 can be made for other shots in a game of tennis, equally for "smash", "passing-shoot", "lob", "volley", "service", etc., and in sizes suitable to the categories of the players, be they infants, juniors, adults, male, female, etc.

What is claimed is:

1. A device for a training of a first human body extremity in a practice of a specific physical activity, particularly a device aimed at educating the first human body extremity so that it easily adopts by means of a first connecting joint a correct position for an exercising of a sporting activity, the device comprising:

a concave mould that is made up of at least a rolled piece of light and substantially rigid material wherein the concave mould comprises:

a first part that substantially wraps around the first extremity, the first connecting joint, and a piece of sporting equipment, wherein the first part holds the first extremity and the first connecting joint at an optimally correct position for the piece of sporting equipment during the exercise of a type of action in the sporting activity, and a second part that substantially wraps around a part of a first limb that is connected to the first connecting joint, wherein the second part includes an openable means for affixing the second part to the first limb.

2. A device, in accordance with claim 1, wherein the first part is capable of housing, in the correct position for holding the piece of equipment, a second extremity and a second connecting joint of a second limb, whilst the second part houses only one of the first limb or the second limb and includes an openable means for affixing the second part to the housed first or second limb.

3. A device, in accordance with claim 1, wherein the first part allows for the holding of a first hand, a first wrist, and the piece of equipment for the development of the sporting activity, in an adjustable way and without freedom of movement.

4. A device, in accordance with the claim 3, wherein the first part freely allows the direct introduction of a second hand and the piece of equipment is correctly gripped for the development of the physical activity.

5. A device, in accordance with claim 1, wherein the first part and the second part correspond to two independent rigid pieces that can be fitted together in an openable way.

6. A device, in accordance with claim 5, further comprising:

a size and a shape for the second part that is constant for a same limb size, and a plurality of pieces for the first part, wherein each piece for the first part corresponds to a position to be adopted by the extremity and the connecting joint for each type of action and posture of the sporting activity.

7. A device, in accordance with the claim 1, further comprising:

an internal surface of the mould that has a non-aggressive springy nature for the user's extremity, joint and limb.

8. A device, in accordance with the claim 7, wherein the internal surface of the mould is provided with a cushioning.

9. A device, in accordance with the claim 8, wherein the cushioning is of a type that can be inserted and removed.

10. A device, in accordance with the claim 1, wherein the light and rigid material of the moulded piece is one of a group of materials, such as synthetic resins, reinforced or not, and light metals, all of which can be separate or in combination.

* * * * *